United States Patent [19]

Matsui et al.

[11] Patent Number: 4,798,348

[45] Date of Patent: Jan. 17, 1989

[54] YARN END FINDING DEVICE

[75] Inventors: Isamu Matsui, Kyoto; Noboru Sekitani, Ohtsu, both of Japan

[73] Assignee: Murata Kikai Kabushiki Kaisha, Kyoto, Japan

[21] Appl. No.: 909,495

[22] Filed: Sep. 19, 1986

[30] Foreign Application Priority Data

Sep. 24, 1985 [JP] Japan ..... 60-210593

[51] Int. Cl.[4] ..... B65H 54/00

[52] U.S. Cl. ..... 242/35.6 E; 242/18 R

[58] Field of Search ..... 242/35.6 E, 35.6 R, 242/35.5 R, 35.5 A, 18 R, 18 EW

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 3,563,478 | 2/1971 | Bell | 242/35.6 R |
| 3,941,323 | 3/1976 | D'Agnolo et al. | 242/35.6 E X |
| 4,544,107 | 10/1985 | Matsui et al. | 242/35.5 A |
| 4,545,551 | 10/1985 | Uchida et al. | 242/35.5 A |
| 4,576,341 | 3/1986 | Matsui et al. | 242/35.5 A |
| 4,598,869 | 7/1986 | Uchida et al. | 242/35.5 A |
| 4,613,091 | 9/1986 | Kiriake | 242/35.5 A |
| 4,616,789 | 10/1986 | Matsui et al. | 242/35.5 R |
| 4,619,416 | 10/1986 | Matsui et al. | 242/35.5 A X |
| 4,634,066 | 1/1987 | Matsui et al. | 242/35.5 A |

*Primary Examiner*—Stanley N. Gilreath

*Attorney, Agent, or Firm*—Spensley Horn Jubas & Lubitz

[57] ABSTRACT

A yarn end finding device for a spinning bobbin produced in a spinning frame. A bobbin rotating and driving device and a bobbin discriminating device are provided on a bobbin processing station in a yarn end finding device, and the rotating direction of the bobbin rotating and driving device is switched by a signal for detecting a kind of bobbins according to the discriminating device.

12 Claims, 7 Drawing Sheets

YARN END FINDING DEVICE

FIELD OF THE INVENTION AND RELATED ART STATEMENT

The present invention relates to a yarn end finding device for a spinning bobbin.

In spinning bobbins (hereinafter merely referred to as bobbins) produced by spinning frames, particularly ring spinning frames, generally, a bunch winding is applied to an end of a take-up tube in the longitudinal center of the bobbin. In supplying such a bobbin to an automatic winder in the rewinding step, the bobbin is supplied in a state where the bunch winding is released. For this reason, a yarn end finding device is installed in the vicinity of the winder.

In the yarn end finding device, when the bunch winding is released or when a yarn of a certain length is drawn from a yarn layer, the yarn is drawn while directly or indirectly rotating the bobbin in a direction of releasing the yarn.

Recently, there are various kinds of bobbins processed by a system for producing a variety of and a small volume of bobbins. For example, there are bobbins of two kinds, one whose yarn winding direction of a yarn layer on the bobbin is an S-direction and that is a Z-direction, bobbins different in yarn number count, and bobbins different in diameter, length, etc.

OBJECT AND SUMMARY OF THE INVENTION

It is an object of the present invention to provide a device in which bobbins different in winding direction of the bobbins are supplied by a single yarn end finding device and even in case where a supply of bobbins to the yarn end finding device is random, the yarn end finding operation is effected without fail in yarn end finding.

According to the present invention, a bobbin rotating and driving device and a bobbin discriminating device are provided on a bobbin processing station in a yarn end finding device, and the rotating direction of the bobbin rotating and driving device is switched by a signal for detecting a kind of bobbins according to the discriminating device.

DETAILED DESCRIPTION OF PREFERRED EMBODIMENTS

In the following, the embodiments of the present invention will be described with reference to the drawings.

While in this embodiment, a yarn end finding device wherein a bunch winding is applied to a lower portion of a bobbin is illustrated, it is noted that the device may also be applied to the case where a bobbin having a top bunch is handled. In addition, while in the present embodiment, the description will be made of the case where in a bunch winding cutting station of a yarn end finding device and a yarn end finding station, a rotating roller is brought into contact with a tray to thereby rotate the tray, as a consequence of which the bobbin on the tray is rotated to facilitate the releasing of the yarn end, it is to be noted of course that the bobbin may be rotated directly by the rotating roller.

Figure 1:
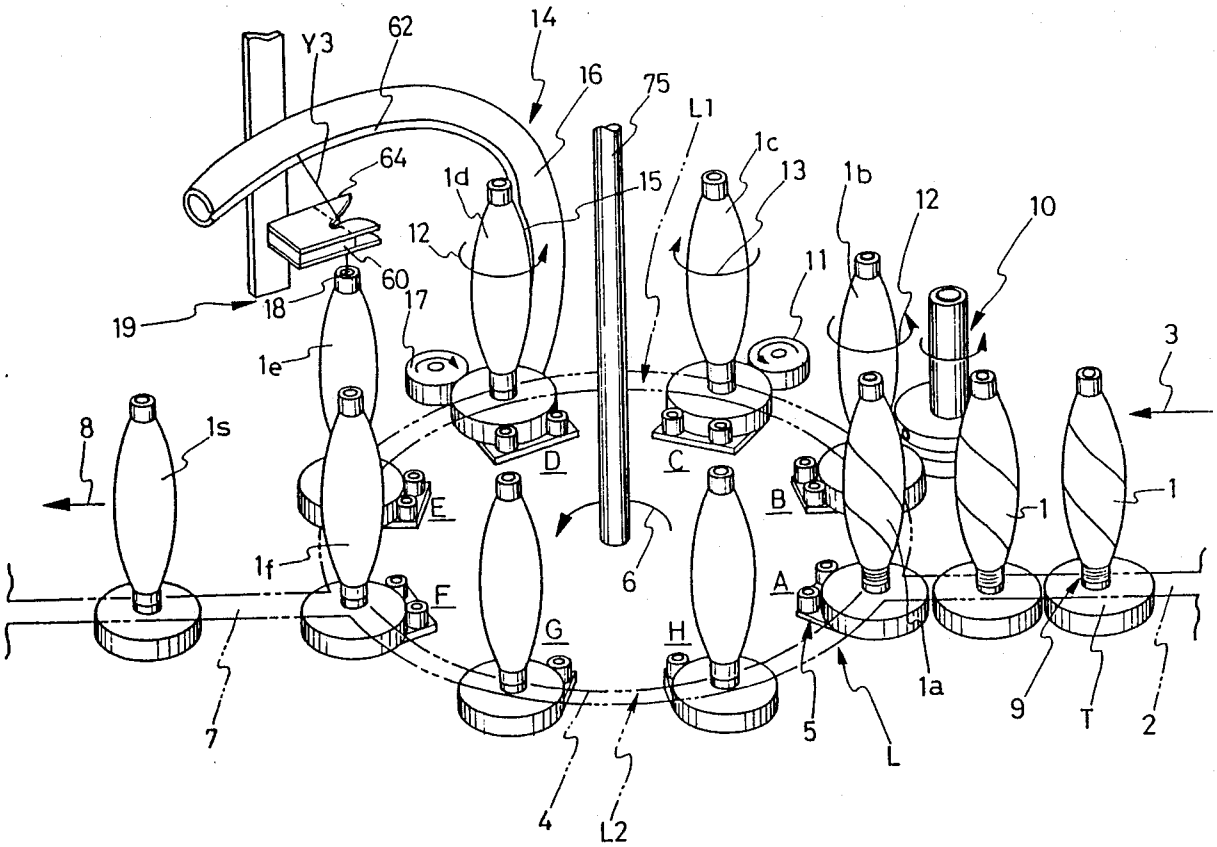
FIG. 1 is a perspective view showing an embodiment of the apparatus according to the present invention.

FIG. 1 shows a schematic construction of a yarn end finding device. A spinning bobbin 1 held upright on a tray T is transported in a direction indicated by arrow 3 on a transporting passage 2 and arrives at a receiving position A of the yarn end finding device. A bobbin 1*a* received in tray receiving portions 5 formed at regular pitch intervals on a rotary disc 4 of the yarn end finding device arrives at an ejection station F via various processing stations B, C, D and E, upon intermittent rotation of the rotary disc 4 in a direction as indicated at 6. A bobbin with the success of yarn end finding is transported in a direction as indicated by arrow 8 on a transporting passage 7 toward the winder.

In the station B is arranged a cutter device 10 for releasing and cutting a bunch winding 9 wound around a lower end portion of the bobbin, and in the station C is arranged a rotating roller 11 for drawing a yarn extended between a bobbin 1*c* and the cutter 10 to lightly wind it around the surface of a yarn layer. In the station B, a bobbin 1*b* is subjected to rotation by a friction roller in a direction at 12 where a wound yarn is released, and in the station C, it is subjected to rotation in a direction at 13 where a yarn is wound by the roller 11. Furthermore, in the station D is arranged a yarn end finding device 14 for sucking and releasing a free yarn, which is for example composed of a suction mouth 16 having a slit 15. At that position, a bobbin 1*d* is subjected to rotation in a direction at of releasing the yarn by a friction roller 17. Moreover, in the station E is provided a yarn end inserting mechanism 19 for cutting a yarn drawn from the bobbin into a predetermined length to insert the yarn end into a center hole 18 of a bobbin 1*e*.

The bobbin tray T in the present embodiment comprises a disk-like base 20 on which a bed portion 21 and a peg 22 for holding a bobbin upright thereon are integrally formed. The tray is interiorly formed with a hollow portion opened to a bottom surface. The peg 22 is bored with an air vent hole 24. A flow of downward suction air is forced into the tray T whereby a suction is made to act on the interior of the center hole 18 of the bobbin through the air vent hole 24.

Figure 2:
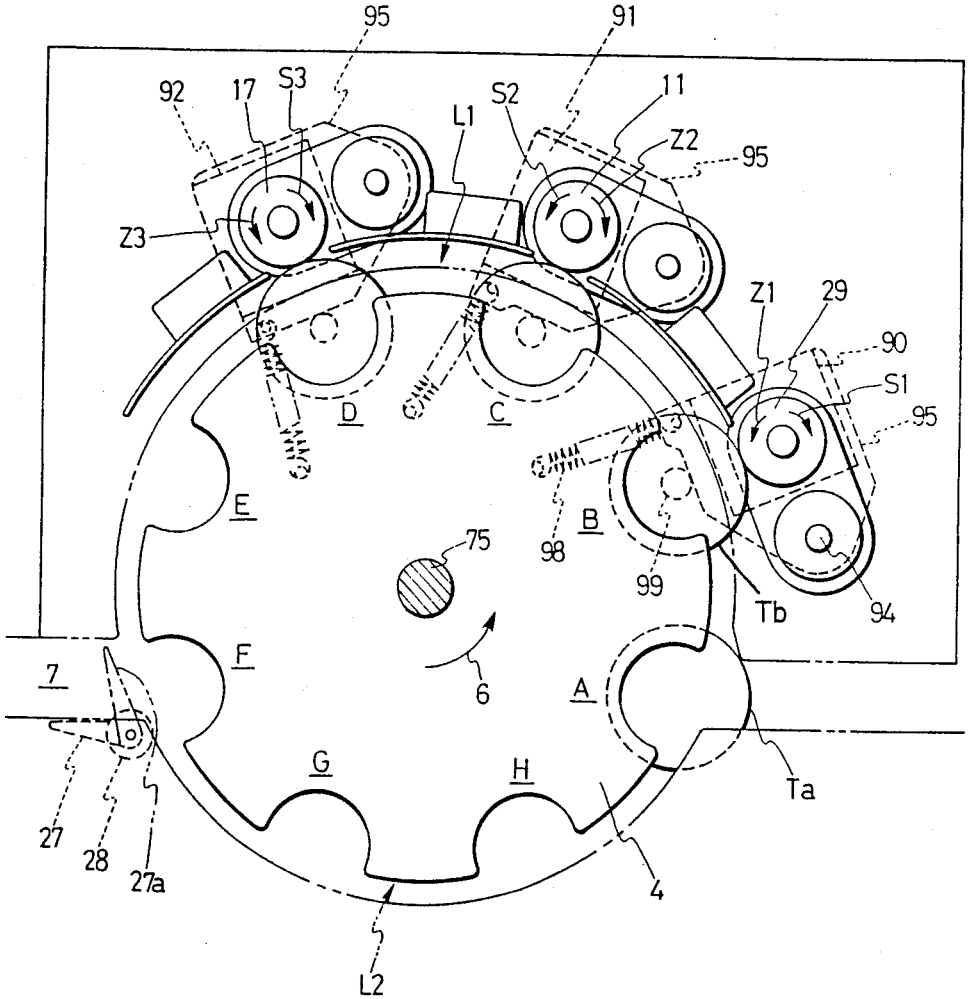
FIG. 2 is a plan view of the same.

FIG. 2 is a plan view showing bobbin processing stations. When a tray T*a* with a bobbin held upright arrived at the receiving position A arrives at the ejection position F through the processing stations B to E along a passage L1 by intermittent rotation every 45 degrees of the rotating plate 4 in a direction as at 6, the bobbin with success of yarn end finding is ejected to the transporting passage 7 whereas the bobbin with the failure of the yarn end finding is checked by a movable guide 27*a* and thence arrives again at the receiving position A via a feedback passage L2 for repetition of operation similar to that as previously mentioned. That is, in the processing station E, a sensor for detecting a yarn end is provided. When the sensor detects an absence of yarn, a movable guide 27 is located at a position 27*a* by means of a rotary solenoid 28, etc. to check the ejection of a tray Tf arrived at the position F.

Figure 3:
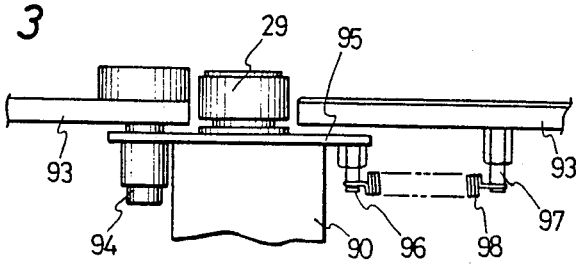
FIG. 3 is a side view of the same.

Rotating rollers 29, 11 and 17 for rotating bobbins at respective positions in the processing stations B, C and D and driving sources 90, 91 and 92 will be described with reference to FIG. 2. These constructions are entirely the same and therefore the rotating roller 29 and the driving source 90 in the station B will be described with reference to FIGS. 2 to 4.

A shaft 94 is secured to the lower surface of a fixed bottom plate 93, and a motor supporting plate 95 is swingingly supported on the shaft 94.

A motor 90 is secured to the plate 95, and the rotating roller 29 is fixedly mounted on the output shaft of the motor 90. A tension spring 98 is passed over and between a pin 96 of the plate 95 and a pin 97 of the bottom plate 93 to always urge the plate 95 around the shaft 94 counterclockwise, the spring 98 being pressed against the outer peripheral surface of the base of the tray T*b* in the station B. In FIG. 2, a reference numeral 99 designates a stopper for the plate 95.

Thus, the rotating rollers 29, 11 and 17 in the stations B, C and D may be rotated independently, and the rotational direction thereof is controlled by the direction of winding the bobbin.

More specifically, in the station B, it is necessary that the roller 29 rotates in a direction of releasing a yarn. Therefore, where a bobbin on a tray is a bobbin wound in a Z-direction, the roller 29 is rotated in the Z1 direction, and where a bobbin is a bobbin wound in an S-direction, the roller 29 is rotated in the S1 direction.

It is also necessary that in the station C, a bobbin is rotated in a direction where a drawn yarn is lightly wound about a bobbin. Therefore, in case of a bobbin wound in a Z direction, the roller 11 is rotated in a direction as indicated by arrow Z2. In case of a bobbin wound in an S direction, the motor 91 is controlled so that the roller 11 is rotated in a direction as indicated by an arrow S2.

In the station D, the bobbin is rotated in a direction of releasing the yarn. Therefore, the rotational direction of the roller 17 is similar to the case of the station B. In case of a bobbin wound in a Z direction, the roller 17 is rotated in a direction as indicated by an arrow Z3. In case of a bobbin wound in an S direction, the roller 17 is rotated in a direction as indicated by an arrow S3.

Figure 4:
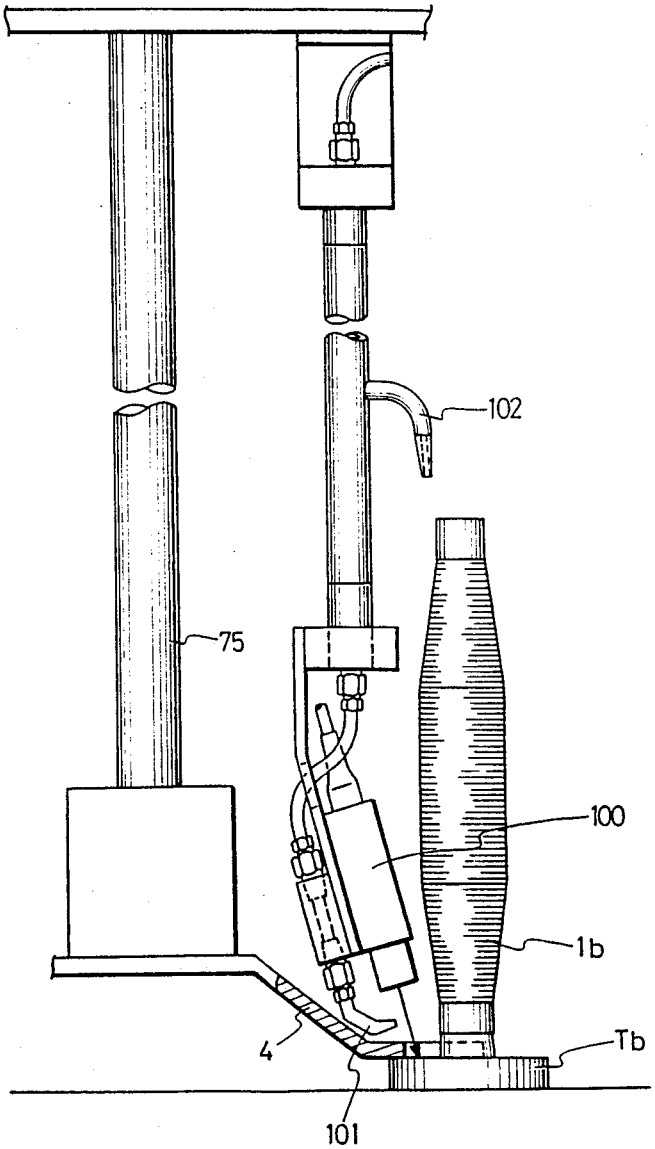
FIG. 4 is a front view of a station B.

Apparatus for discriminating kinds of bobbins arrived at the aforesaid stations comprises, for example, a mark sensor 100 installed in each of the stations as shown in FIG. 4. In this case, a bobbin wound in a Z direction is held upright on a black tray, and a bobbin wound in an S direction is held upright on a white tray. Colors of the trays arrived at the respective stations are red by the mark sensor 100 to sort out the bobbin on the tray. The rotational direction of the motor is controlled by the thus read kind signal. The mark sensor 100 provided in the station B shown in FIG. 4 is likewise arranged also in another stations C and D. FIG. 4 shows the case of the station B. Therefore, air nozzles 101 and 102 are provided to facilitate the release of the bunch winding, and air is injected against the bunch winding position of the bobbin and the yarn-layer surface.

Next, the processing mechanism provided in the respective stations will be described.

Figure 5:
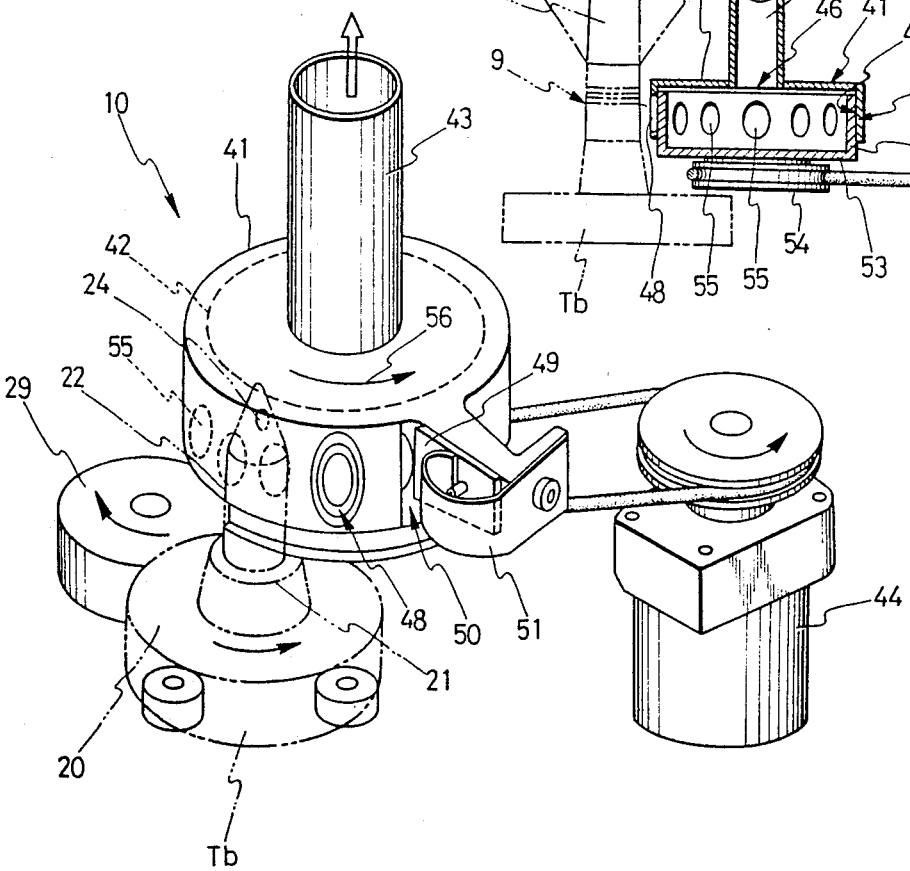
FIG. 5 is a perspective view of a cutter device for the bunch winding.
Figure 6:
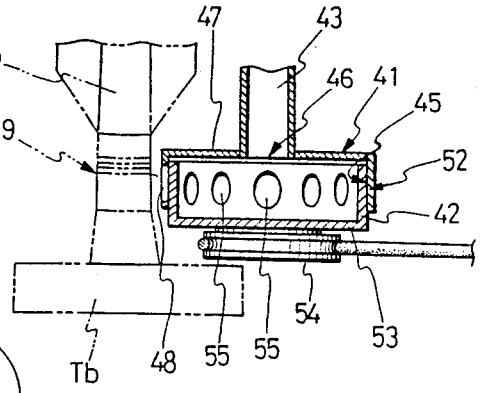
FIG. 6 is a sectional view of the same.

FIGS. 5 and 6 show a cutter device 10 for releasing and cutting the bunch winding provided in the processing station B. The cutter device 10 has a suction case 41 secured to and supported on the fixed frame and a rotating cutter 42 rotated within the suction case 41. A suction pipe 43 for generating a flow of suction air and a motor 44 for driving the cutter 42 and the like are arranged and connected in the space internally of the cutter 42, as well as a friction roller 29 for rotating the bobbin in a direction of releasing the yarn.

The aforesaid suction case 41 is composed of an inner peripheral surface 45 having substantially the same diameter as the outer peripheral surface of the drum-like rotating cutter, and an upper wall surface 47 having a suction air flowing hole 46. The case 41 is formed in a part of the outer peripheral surface thereof with a yarn end sucking opening 48 and a cut portion 50 for bringing a knife edge of a fixed cutting edge 49 into abutment with the outer peripheral surface of the rotating cutter, which are spaced apart. A reference numeral 51 denotes a plate spring for urging the edge 49 against the supporting surface of the case.

The rotating cutter 42 accommodated within the suction case 41 is composed of a pulley which is in the form of a drum having an outer peripheral wall surface 52 and a bottom wall surface 53 and which is fixed integral with the cutter 42, and yarn-end passing holes 55 formed in equally spaced apart in the outer peripheral wall surface 52. The holes 55 are preferably circular in shape and the cutter constitutes the peripheral edges of the holes and the fixed cutting edge 49.

The suction case 41 is secured at a position where the opening 48 portion of the suction case moves from the side closer to the bunch wound portion 9 of the bobbin 1*b* arrived at the station B as shown in FIG. 6. Accordingly, in the present embodiment, the bunch winding is located below the bobbin, and the suction case is also fixed at the same position as the above. However, where a bobbin having a so-called top bunch wherein the bunch winding is located above the bobbin is handled, it is natural that the suction case is also set at a position corresponding to the top bunch winding position.

Thus, when the rotating cutter 42 is rotated in a direction as indicated by an arrow 56 and a flow of suction air is caused to generate within the drum 42, a yarn end wound around the lower end of the bobbin 1*b* or a yarn Y1 intertwined with a yarn is begun to be unwound passing through the opening 48 of the suction case 41 and the holes 55 in the peripheral surface of the drum by the incluence of suction of the drum 42 and to be sucked into the interior 42*a* of the drum. Then, the end of the yarn is released by the rotation of the drum and the rotation of the bobbin 1*b* in a direction as indicated by an arrow 12, namely the rotation of the bobbin in the direction opposite the winding direction of the yarn. When the yarn end Y1 is once sucked into the drum, the yarn drawn out of the bobbin is transferred through a clearance between the casing 41 and the drum 42 while being sucked onto the peripheral surface of the drum. Thus, the yarn is forcibly released from the bobbin.

The thus transported yarn Y1 is cut by the rear end edge of the hole 55 and the fixed edge 49 when the hole 55 of the drum 42 with the yarn sucked thereon passes through the position of the fixed edge 49. The thus cut waste yarn is discharged into the suction pipe 43. When the drum 42 is further rotated, a yarn within a successing hole is likewise cut.

For applying the clearance between the opening 48 of the suction case 41 and the bunch wound portion of the bobbin also to a bobbin of a different kind which is different in diameter of a bobbin, the whole cutter mechanism is placed on a movable bracket so that it may be moved according to the kinds of bobbins. Then a plurality of kinds of bobbins may be handled.

Next, apparatus for receiving and inserting a found yarn end into a predetermined position of a bobbin will be described with reference to FIG. 7. In the present embodiment there is shown a type of bobbin in which a yarn end is inserted from top into a center hole 18 of the bobbin and the bobbin is transported.

More specifically, the yarn end inserting device is provided over the processing stations D and E. This device is composed of a suction mouth 16 provided in the station D, a cutter 60 for detecting the presence of a yarn to cut the yarn at its predetermined length position, said cutter being provided in the station E, and a yarn end suction mechanism 61 for sucking the cut yarn end into the center hole 18 of the bobbin.

The suction mouth 16 is composed of a substantially L-shaped suction pipe 63 having a slit-like opening 15 extending in length of a yarn layer of a bobbin 1d at the position of the station D and a slit 62 connected to the opening 15 and extending above a yarn detection and cutter device 60 at the position of the station E. The pipe 63 is connected to a suction blower not shown.

In the station E, above the bobbin le at that position are provided guide plates 64, 64 for guiding a yarn Y3 between the bobbin le and the slit 62 of the suction mouth to the device 60, the guide plates 64 being secured by a support 65 integral with the cutter device 60. A guide member 67 for guiding and positioning a head 66 of the bobbin to be transported at a predetermined position is secured to the support 65. While the cutter device 60 applied comprises a device which houses therein a yarn detection function and a cutter function such as a slab catcher with a cutter used in the winder, it is noted of course that a device in which a yarn detection is provided separately from a cutter may also be applied.

Furthermore, directly under the tray at the position of the station E is provided an opening 72 of a suction pipe 71 to exert a flow of suction air into the interior of the center hole of the bobbin 1*e*. Thus, when the bobbin 1*e* arrives at the position of the station E and the drawn yarn is cut above the center hole of the bobbin, a cut yarn end connecting to the yarn layer is sucked into the center hole by the suction exerting in the interior of the center hole, thus completing one cycle of the yarn end finding operation.

Next, a rotating member for transferring a bobbin along the stations A to F will be described.

Figure 8:
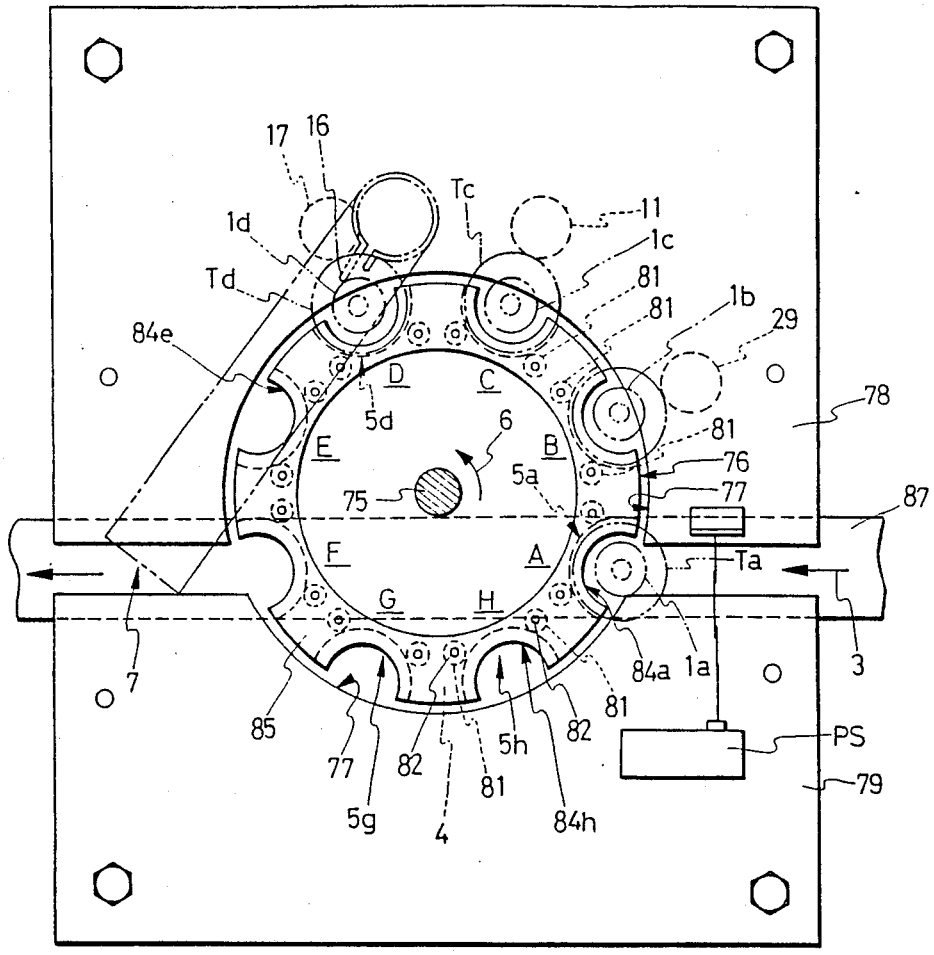
FIG. 8 is a plan view showing an embodiment of a tray transferring and rotating plate.
Figure 9:
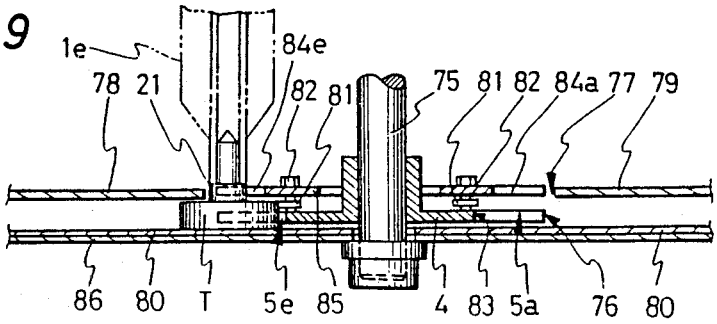
FIG. 9 is a side view in section of the same.

In FIGS. 8 and 9, a rotating plate 4 formed in the periphery thereof with tray receiving grooves 5*a* to 5*h* at equal pitches is secured to a vertically extending shaft 75, and outer guide plates 78 and 79 spaced apart from an imaginary outer peripheral surface 76 of the rotating plate 4 and having a guide surface in the form of a concentric circle. The aforesaid receiving grooves 5*a* to 5*h*, guide plates 78 and 79, plate 80, and the like constitute a transporting passage for trays.

The tray receiving grooves 5*a* to 5*h* are formed from a substantially semi-circle portion of a circle having a diameter substantially equal to that of the tray. In the illustrated embodiment, eight receiving grooves 5*a* to 5*h* are formed at a pitch of 45°.

Moreover, at two positions in the peripheral surface of each of the receiving grooves, the paired rollers 81, 81 are provided on shafts 82, 82 to smoothly effect tray positioning and rotation of a tray in the processing station. The contact surface of the rollers 81, 81 with the tray somewhat projects from the peripheral surface 83 of the receiving groove so that the outer peripheral surface of the tray is not completely in contact with the inner peripheral surface of the receiving groove.

Above the rotating plate 4, a guide plate 85 formed with circular grooves 84*a* to 84*h* at the same position as the receiving groove is secured to shafts 82, 82 of the rollers 81, 81 so that the circular grooves 84*a* to 84*h* are positioned at the bed 21 portion of the tray T as shown in FIG. 9 to prevent the tray during its movement from being fallen down or from being jumped up.

In the following, the yarn end finding operation of the yarn end finding apparatus having the above-described various mechanisms will be described.

In FIG. 8, the tray T*a* with the spinning bobbin la held upright, which is being transported in the direction of the arrow 3 on the conveyor 87, passes in front of the phototube sensor PS and moves toward the receiving groove 5*a* which awaits at the position of the tray receiving station A of the rotating plate 4.

When the phototube sensor PS detects the passage of the tray, the rotating plate 4 is rotated by one pitch portion in the direction of the arrow 6 at a predetermined time lag through a timer. That is, since the rotating plate is not rotated unless the sensor PS detects the passage of the tray, the trays are received without fail in the receiving grooves 5*a* to 5*e* in the stations A to E of the rotating plate 4, and no empty state occurs in the stations A to E. It is noted that a mixed state of empty and occupied states sometimes occurs in the receiving grooves 5*g* and 5*h* located after the ejection station E as the case may be. That is, in the illustrated apparatus, it is controlled so that a bobbin which fails in finding of a yarn end is immediately returned to the receiving station A via the bypass stations G and H without being ejected onto the conveyor 87 from the ejection station F, and the bobbin is then again subjected to yarn end finding operation taking precedence over the bobbin on the conveyor 87.

As for the bobbin 1*b* arrived at the processing station B, the bunch winding wound around the lower end of the bobbin is released and cut by the cutter device 10 shown in FIGS. 5 to 6.

At that time, where a bobbin on the tray T*b* is a bobbin wound in a Z direction, the roller 29 rotates in the direction of the arrow Z1 as shown in FIGS. 2, and in case of the bobbin wound in the S direction, the roller 29 rotates in the direction of the arrow S1. The rotational direction of the rotating cutter 10 can be constant or the rotational direction thereof may be changed likewise the roller 29. However, in this case, it is necessary to provide the fixed cutting edge 49 of FIG. 5 also on the side opposite to the yarn end passing hole 48.

Consecutively, the bobbin in the station B is transported to the station C, where the friction roller 11 abuts with the tray TC so that the bobbin 1*c* is rotated in a direction of winding a yarn through the tray, and a released yarn between the bobbin 1*c* and the cutter 10 of the station B is wound around the surface of the yarn layer of the bobbin 1*c*. In this case, the winding of the yarn end does not mean that the yarn end is held and wound positively around the bobbin but a yarn having a free end is lightly wound passively by the rotation of the bobbin, that is, the yarn is not wound so hard as to make it difficult to draw a yarn end at the succeeding station.

Subsequently, the bobbin 1*d* arrived at the station D is rotated in a direction of releasing the yarn by the contact between the friction roller 17 and the tray T*d*, and the yarn end is released and sucked by the suction mouth 16 positioned in close promixity of the surface of the yarn layer. The drawn yarn is moved along the slit 62 shown in FIG. 1, and a passage of a yarn is formed between the station D and the slit.

Figure 7:
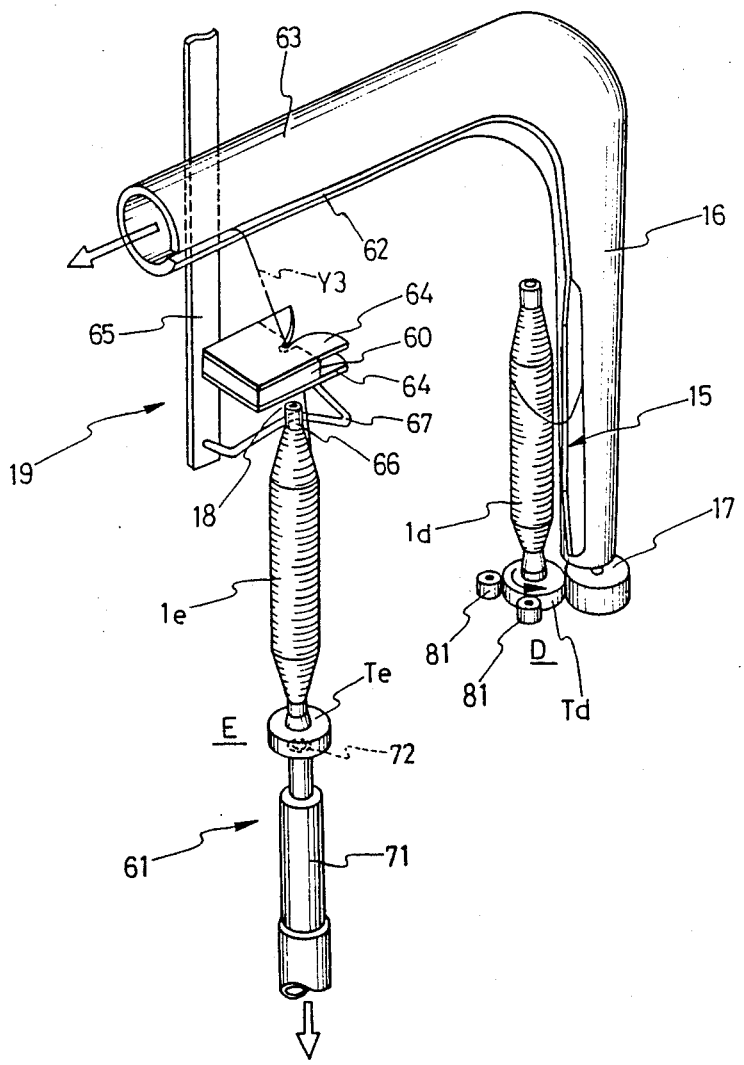
FIG. 7 is a perspective view showing a schematic construction of a yarn end finding and inserting device.

When the bobbin is then transported from the station D to the station E, the drawn yarn Y3 is guided by the guide plates 64, 64 into the cutter device 60 as shown in FIG. 7 to actuate a yarn detection feeler. At that time, a flow of suction air is generated in the suction pipe 71 arranged under the tray Te in the station E so that the yarn end cut at the cutter 60 position is sucked and inserted into the center hole 18 of the bobbin to complete the step of yarn end finding.

Thus, the bobbin arrived at the station F is in the state where a yarn end having a predetermined length is suspended into the center hole from the head of the bobbin, and the bobbin is ejected, as a bobbin held upright on the tray, onto the transporting passage 7 for a supply thereof to the winder.

The rotational speed of the rotating rollers 29, 17 and 11 is such that the speed of the roller 29 is highest, and the revolutions of the rollers 17 and 11 are reduced in said order. For example, the roller 29 is 7.5 r.p.s., the roller 17 is 5 r.p.s. and the roller 11 is 1.8 r.p.s.

That is, the roller 29 is highest in speed because the bunch winding of the bobbin 1*b* at that position is wound around the winding tube having a small diameter said bunch winding is to be released. The roller 11 is low in speed because a yarn between the cutter 10 and the bobbin 1*c* at the position C is merely lightly wound around the surface of the yarn layer. The speed of the roller 17 is set in connection with the suction of the suction mouth for sucking the yarn end of the yarn-layer surface. That is, when the roller 17 is rotated at a high speed, there is a fear that the released yarn is reversely wound around the bobbin. It is necessary that the yarn end is released by maintaining the balance with the suction force.

In the embodiment afore-mentioned, the sensors for discriminating the kind of bobbins are provided at each of the processing stations B, C and D. However, it is possible that a sensor is only provided at the station B and is not provided at the stations C and D. In this embodiment, a rotating direction of a bobbin which arrives at the station C or D is controlled by a discriminating signal stored at the station B.

Figure 10:
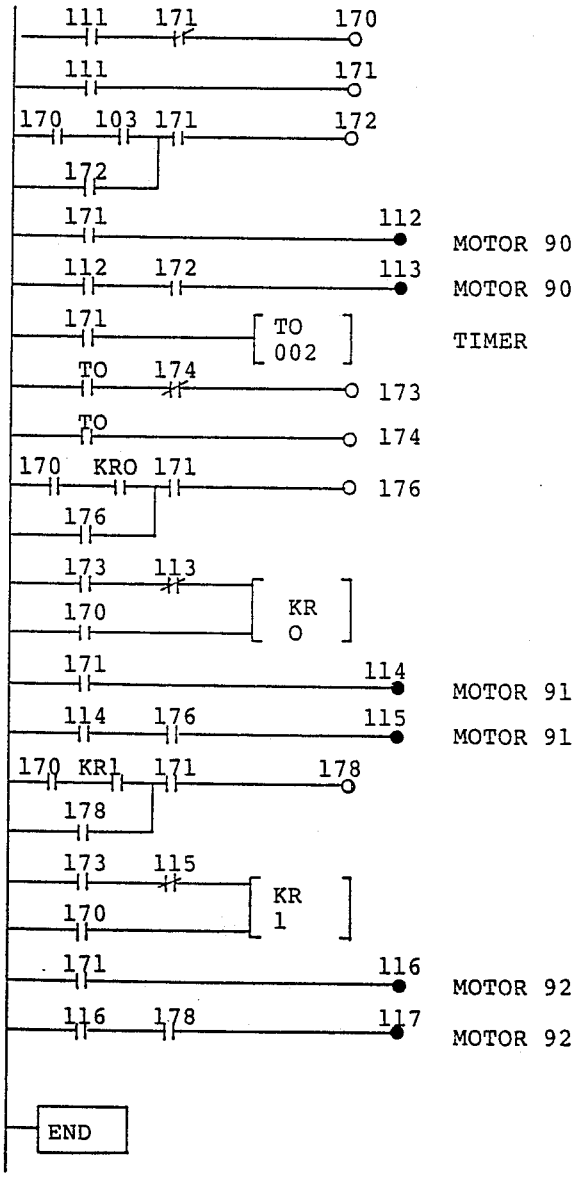
FIG. 10 is a sequence diagram.

For example, a control of the rotating direction of a bobbin may be performed by a sequence diagram shown in FIG. 10.

A relay 112 is switched on when the motor 90 is driven. When a relay 113 is switched on, the motor 90 is forwardly revolved and when the relay 113 is switched off, the motor 90 is backwardly revolved. ON or OFF of the relay 113 is controlled by a relay 172. The relay 172 is energized or de-energized by a contact 103 which is switched on or off according to a signal from a sensor which is provided at the station B. Accordingly, when it is discriminated by a color of a tray that the tray just arrived at the station B carries a S-twist bobbin thereon, the contact 103 is closed and the relay 172 is energized. Then, the motor 90 is revolved by ON of relay 113 and ON of the relay 112, forwardly, that is, in the direction where a yarn wound on a S-twist bobbin is released. On arriving of the S-twist bobbin at the station C, a relay 115 is switched off because a relay 176 is OFF through a keep relay KRO. According to ON of a relay 114 for driving the motor 91, the motor 91 is revolved backwardly that is, in a direction where the yarn of S-twist bobbin is wound around the yarn layer of the S-twist bobbin. When the S-twist bobbin is arrived at the station D, the relay 117 is switched on through the keep relay KR1 and the motor 92 of the station D is revolved forwardly by ON of the relay 116. Thus, the signal obtained by a mark sensor at the station B is once stored and acts to control a revolving direction of the motor 91 or motor 92 in the station C or D when a bobbin arrives at the station C or station D, respectively.

As described above, in the present invention, the yarn end finding can be accomplished with respect to bobbins different in winding direction supplied at random by a single yarn end finding device, which is very effective.

What is claimed is:

1. A yarn end finding device for finding a yarn end on a yarn layer wound on a spinning bobbin comprising:

a bobbin processing station having means for separating said yarn end from said yarn layer wound on said spinning bobbin, a bobbin rotating and driving device for rotating said spinning bobbin in a first direction of rotation relative to said bobbin processing station and in a second direction of rotation relative to said bobbin processing station, and a discriminating device for discriminating the winding direction of said yarn layer wound on said spinning bobbin, control means for controlling said bobbin rotating and driving device in response to said discriminating device so that the rotating direction of said spinning bobbin relative to said bobbin processing station is controlled according to the winding direction of said yarn layer wound on said spinning bobbin.

2. A yarn end finding device for finding a yarn end on a yarn layer wound on a spinning bobbin comprising:

a rotary disc having bobbin carrier receiving portions formed therein at regular pitch intervals, a plurality of processing stations disposed around the rotary disc at the same pitch intervals as the bobbin carrier receiving portions, a bobbin rotating and driving device associated with at least one of said processing stations for rotating said spinning bobbin in a first direction of rotation relative to said processing stations and in a second direction of rotation relative to said bobbin processing stations, and a discriminating device for discriminating the winding direction of said yarn layer wound on said spinning bobbin, control means for controlling said bobbin rotating and driving device in response to said discriminating device so that the direction of rotation of said spinning bobbin relative to said bobbin processing stations is controlled according to the winding direction of said yarn layer wound on said spinning bobbin.

3. A yarn end finding device as claimed in claim 2, wherein said plurality of processing stations comprises:

a first processing station having a first friction roller for rotating a bobbin having a bunch winding in a direction in which said bunch winding is released and having a cutter device for cutting the released yarn, a second processing station having a second friction roller for drawing a yarn extended between the bobbin and the cutter device to thereby lightly wind the yarn around the surface of the yarn layer of the bobbin, and a third station comprising a suction mouth having a slit and a third friction roller for rotating the bobbin in a direction in which the yarn from the surface of the yarn layer of the bobbin is released.

4. A yarn end finding device as claimed in claim 3, wherein at least one of said first, second and third friction rollers is fixedly mounted on an output shaft of a motor, said motor being disposed on a supporting plate swingingly supported on a stationary shaft.

5. A yarn end finding device as claimed in claim 4, further comprising:

a tension spring extending between said swingable supporting plate and a stationary plate to urge the supporting plate toward said bobbin carrier receiving portion of the disc to thereby cause said friction roller to come into pressing contact with an outer peripheral surface of the bobbin carrier.

6. A yarn end finding device as claimed in claim 2, wherein said discriminating device comprises:

a mark sensor for sensing the winding direction of yarn wound on said bobbin and generating a signal in response thereto, and means for controlling the rotating direction of said rotating and driving device in response to the signal generated by said mark sensor.

7. A yarn end finding device as claimed in claim 3, wherein said first friction roller has a rotational speed which is greater than that of the third and second friction rollers.

8. A yarn end finding device for finding a yarn end on a yarn layer wound on a spinning bobbin comprising:

detection means for detecting the winding direction of said yarn layer wound on said spinning bobbin, separation means for separating said yarn end from said yarn layer wound on said spinning bobbin, rotation means for rotating said spinning bobbin in a first direction of rotation relative to said separation means and in a second direction of rotation relative to said separation means, control means for controlling said rotation means in response to said detection means so that the direction of rotation of said spinning bobbin relative to said separation means is controlled according to the winding direction of said yarn layer wound on said spinning bobbin.

9. A yarn end finding device for finding a yarn end on a yarn layer wound on a spinning bobbin comprising:

detection means for detecting the winding direction of said yarn wound on said spinning bobbin, first bobbin processing means for selectively rotating said spinning bobbin in a first direction of rotation relative to said first bobbin processing means and in a second direction of rotation relative to said first bobbin processing means and for releasing and cutting said yarn end, second bobbin processing means for selectively rotating said spinning bobbin in a first direction of rotation relative to said second bobbin processing means and in a second direction of rotation relative to said second bobbin processing means and for winding said yarn end around said spinning bobbin, third bobbin processing means for selectively rotating said spinning bobbin in a first direction of rotation relative to said third bobbin processing means and in a second direction of rotation relative to said third bobbin processing means and for releasing and sucking said yarn end, and control means for controlling said first, second and third bobbin processing means in response to said detection means so that the direction of rotation of said spinning bobbin at said first, second and third bobbin processing means is controlled according to the winding direction of said yarn layer wound on said spinning bobbin.

10. A device as in claim 9 wherein said first bobbin processing means rotates said spinning bobbin at a first speed, said second bobbin processing means rotates said spinning bobbin at a second speed, and said third bobbin processing means rotates said spinning bobbin at a third speed.

11. A device as in claim 10 wherein said first speed is greater than said second and third speeds.

12. A device as in claim 10 wherein said first speed is greater than said second speed and said second speed is greater than said third speed.

* * * * *